United States Patent [19]

Mikiya et al.

[11] Patent Number: 4,681,172

[45] Date of Patent: Jul. 21, 1987

[54] CUSHIONING DEVICE FOR USE WITH A PNEUMATIC IMPACT TOOL OR THE LIKE

[75] Inventors: Toshio Mikiya; Minoru Kaneko; Yasuo Kazama, all of Tokyo, Japan

[73] Assignee: Nitto Kohki Co., Ltd., Tokyo, Japan

[21] Appl. No.: 787,228

[22] Filed: Oct. 15, 1985

[30] Foreign Application Priority Data

Oct. 12, 1984 [JP] Japan ..... 59-212476

[51] Int. Cl.[4] ..... B25D 17/24

[52] U.S. Cl. ..... 173/139; 173/162 R; 92/85 B; 91/217

[58] Field of Search ..... 173/139, 134, 116, 162.1; 91/217, 269, 204, 216 R, 217; 92/51, 52, 85 B, 117 R, 117 A

[56] References Cited

U.S. PATENT DOCUMENTS

| | | | |
|---|---|---|---|
| 3,456,744 | 7/1969 | Altschuler | 173/139 X |
| 3,892,280 | 7/1975 | Klushin et al. | 173/139 X |
| 4,363,365 | 12/1982 | Nikolaeu et al. | 173/139 |

*Primary Examiner*—Donald R. Schran
*Assistant Examiner*—Willmon Fridie, Jr.
*Attorney, Agent, or Firm*—Welsh & Katz, Ltd.

[57] ABSTRACT

A cushioning device for use with a pneumatic impact tool which utilizes a part of compressed air for driving the piston of the tool as cushioning means and is self controllable.

3 Claims, 4 Drawing Figures

CUSHIONING DEVICE FOR USE WITH A PNEUMATIC IMPACT TOOL OR THE LIKE

TECHNICAL FIELD

This invention relates to the field of cushioning the movement of a pneumatic impact tool such as a pneumatic chipper or the like.

BACKGROUND ART

Pressure fluid-operated impact tools are usually provided with cushioning means for absorbing vibrations caused by the reciprocating movement of a piston within a cylinder and the shocks transmitted from the chisel.

Japanese utility model application public disclosure No. 58-160725 discloses a fluid-operated impact tool which is equipped with a shock absorbing means utilizing cushioning springs. Such spring type cushioning device requires spring means having a spring constant accommodating the supply air pressure, the frequency of vibrations, and impact forces involved, since the shock absorbing and vibration absorbing capabilities of the device depend on the spring constant. Further, the spring is liable to be completely collapsed upon suffering an impact, resulting in collision between moving parts. For these reasons the spring type cushioning device has proved unsatisfactory from a viewpoint of both construction and performance.

SUMMARY OF THE INVENTION

It is an object of this invention to provide a cushioning device for use with a pneumatic impact tool which utilizes a part of compressed air for driving the piston of the tool as cushioning means, which is simple in construction, and which is self-controllable.

The foregoing object is accomplished by providing a cushioning device for a pneumatic impact tool or the like having a housing means, said device comprising a first cylinder having air inlet port means, a second cylinder having a piston slidably mounted therein and interconnected concentrically with the first cylinder, said first and second cylinders being slidably mounted in the housing means of said impact tool, and an air space defined at least in part by the end face of either the first or second cylinder, a first outer cylindrical sleeve mounted over the first cylinder, and a second cylindrical sleeve interposed between said cylinders and said housing means, said space being adapted to be repeatedly brought into and out of communication with the interior of said first cylinder via said air inlet port means and repeatedly brought out of and into communication with the exterior of said housing means via exhaust hole means, whereby the compressed air confined within the air space may perform the cushioning function in a self-controllable manner.

BRIEF DESCRIPTION OF THE DRAWINGS

This and other objects and advantages of the present invention will become more apparent from the following detailed description taken with reference to the accompanying drawings, in which.

DESCRIPTION OF THE PREFERRED EMBODIMENT

Figure 1:
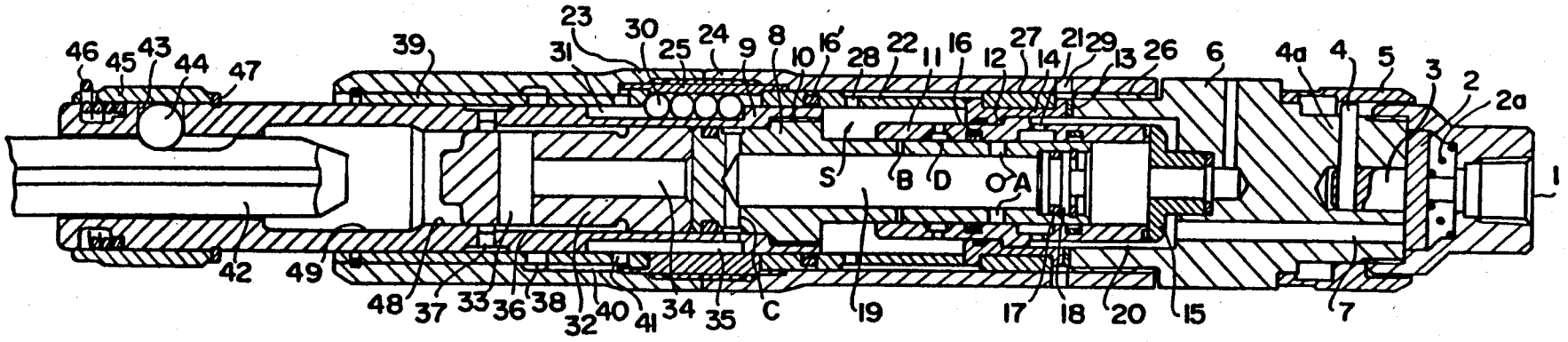
Fig. 1 is a longitudinal cross-sectional view of one embodiment of the impact tool incorporating a cushioning device according to this invention.
Figure 2:
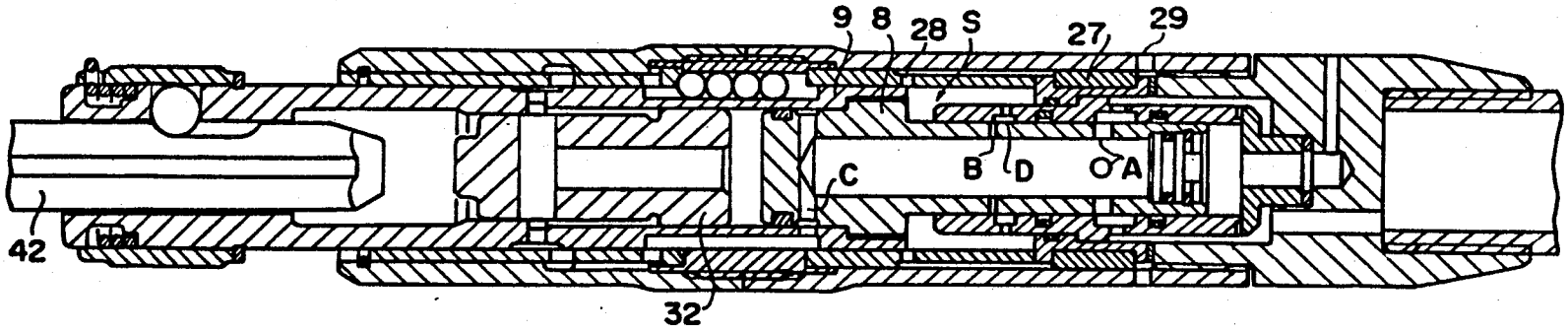
FIGS. 2 to 4 illustrate sequential movements of the cylinder assembly comprising first and second cylinders and of the piston as occasioned by closing and opening of the various air inlet ports, air outlet ports and exhaust holes.

Referring to FIG. 1, an impact tool in the form of a pneumatic chisel tool incorporating a cushioning device according to this invention is shown. 1 is an inlet for compressed air supply to which an air supply hose (not shown) may be suitably connected. 2 is a rotary valve for opening and closing a first air passage 7 for introducing compressed air from the inlet 1 into the main body 6 of the tool. More specifically, the rotary valve is rotatable about its center shaft 3 and is normally biased toward the closed position to close the passage 7 by a spring 2*a*. A lever 4 is fixed to the center shaft 3 and extends radially outwardly through a fan-shaped slot 4*a* formed circumferentially in the main body 6 so as to be engaged by an actuator ring 5, whereby manual circumferential rotation of the actuator ring 5 moves a valve port (not shown) formed axially through the valve 2 into communication with the air passage 7 formed axially through the main body 6 to permit passage of compressed air into a first cylinder 8 and a second cylinder 9 as will be described hereinbelow.

The first and second cylinders 8 and 9 are disposed concentrically with the axis of the main body 6. The second cylinder 9 is threaded as at 10 at its rear end onto the forward end of the first cylinder 8 with their axes in alignment. The first cylinder 8 has air inlet ports (A), air ports (B) and outlet ports (C) formed through its side wall adjacent the rear end, in the central portion and adjacent the forward end, respectively. The inlet ports (A) are in communication with the air passage 7.

A first outer cylindrical sleeve 11 is fitted over the first cylinder 8 to support the latter for axial sliding movement. The sleeve 11 is formed around its outer periphery in the middle thereof with a shoulder 12 against which a retainer ring 14 is pressed to hold the sleeve 11 against an end retainer 15. The ring 14 is mounted over the sleeve 11 in abutment with the front end face of the main body 6 with a seal ring 13 interposed therebetween. The first and second cylinders 8 and 9 are thus axially movable in unison. The outer sleeve 11 is formed through its wall with air outlet ports (D) which are adapted, when aligned with the air ports (B), to establish communication between the interior 19 and the exterior of the first cylinder 8.

A seal ring 16 made of a material having a low frictional resistance and a high wear resistance is disposed to seal the sliding surfaces between the first cylinder 8 and outer sleeve 11. The rear open end of the first cylinder 8 is closed by a plug 18 having O-rings 17 mounted therearound to seal the interior 19 of the cylinder. Communicating with the first air passage 7 is a second air passage 20 defined between the outer peripheries of the outer sleeve 11 and retainer 15 and the inner walls of the main body 6 and retainer ring 14. Air inlet ports 21 formed through the wall of the outer sleeve 11 intermediate its opposite ends are in communication with the second air passage 20 and communicatable with the inlet ports (A) of the first cylinder 8.

A second outer cylindrical sleeve 22 is fitted over the rear end of the second cylinder 9 with a seal ring 16' therebetween to slidably support the second cylinder. The rear end face of the sleeve 22 is in abutment with the front end face of the retainer ring 14.

According to the present invention, an annular air space (S) is defined between the outer periphery of the first cylinder 8, the rear end face of the second cylinder 9 where it is threaded to the first cylinder 8, the outer periphery of the first outer sleeve 11, the inner periphery of the second outer sleeve 22 and the front end face of the retainer ring 14 so that the air as confined within the space (S) will perform the cushioning function for the impact tool as will be described in details hereinafter.

A front housing 23 and a rear housing 24 are connected together by means of a connector 25 with the rear end portion of the rear housing 24 threaded as at 26 onto the main body 6. A filter 27 is disposed to damp the noise of the air exhausted from the annular space (S) through exhaust holes drilled through the wall of the sleeve 22. Exhaust holes 29 drilled through the wall of the rear housing 24 are in communication via the filter 27 with the exhaust holes 28 to discharge the air to the atmosphere.

Balls 30 are mounted in one or more axial elongated grooves 31 formed in the outer peripheral surface of the second cylinder 9 to assist in smooth reciprocal movement of the second cylinder 9 as well as to prevent rotation of the first and second cylinders 8, 9.

A piston 32 is mounted in the second cylinder 9 for free reciprocal movements in front of the front end face of the first cylinder 8. The piston 32 is provided with a diametrical slot 33 and an axially extending bore 34 intersecting at its forward end with the slot 33 and opening at its rear end. Communicating with the outlet ports (C) of the first cylinder are air grooves 35 formed in the outer peripheral surface of the second cylinder 9 in parallel with and between adjacent elongated grooves 31. Defined between the outer periphery of the piston 32 and the inner periphery of the second cylinder 9 is an annular space 36 which is communicatable with the air grooves 35 via inlet ports 37 formed through the wall of the second cylinder 9 and air ports 38 formed through the wall of a third outer cylindrical sleeve 39. The air ports 38 are in communication with one ends of air grooves 40 formed in the inner peripheral wall of the front housing 23 the other ends of which are communicatable with the air grooves 35 via air ports 41 formed through the wall of the third sleeve 39.

A chisel 42 is held within the forward end portion of the second cylinder 9 for limited reciprocal movement but against rotational movement by means of balls 44 mounted in openings 43 formed through the wall of the second cylinder adjacent its front end and engaged in axial grooves formed in the outer surface of the chisel. The balls 44 are prevented from being dislodged from the openings 43 by a retainer ring 45 which is mounted around the second cylinder. The ring 45 is constrained against rotation by a torsional spring 46 and against axial movement by pins 47.

OPERATION

In operation, the rotary valve 2 is rotated to open the air passage 7, and the chisel 42 is pressed against a workpiece whereby the first and second cylinders 8 and 9 are retracted to communicate the inlet ports (A) of the first cylinder 8 and the inlet ports 37 of the second cylinder 9 with the inlet ports 21 and the air ports 38, respectively. When this occurs, compressed air from the inlet 1 flows through the air passages 7 and 20 and into the interior of the first cylinder 8 via the inlet ports (A). Most of the air that has entered the first cylinder flows out through the outlet ports (C) into the air grooves 35 and thence through the air ports 41, air grooves 40, air ports 38 and inlet ports 37 into the space 36 between the second cylinder 9 and the outer periphery of the piston 32. The compressed air then flows through the diametrical slot 33 into the bore 34 closed by the front end face of the first cylinder 8. As the bore 34 is filled with the air, the pressure therein is built up until the piston 32 is instantaneously forced forward.

Figure 4:
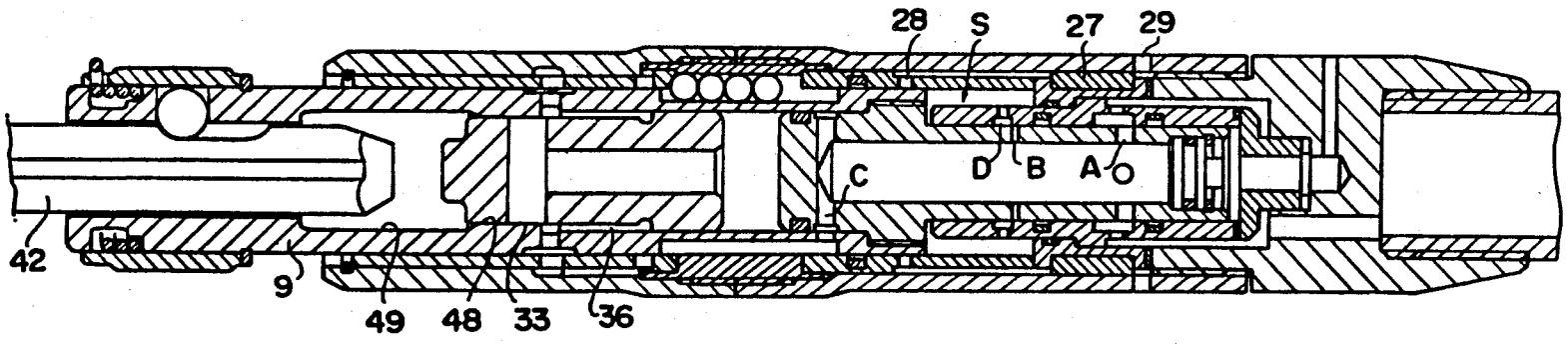

Upon the forward movement the piston 32 strikes the rear end of the chisel 42 to advance the latter. As the piston starts advancing, the diametrical slot 33 of the piston is closed by the wall of the bore 48 of the second cylinder 9 in which the piston slides, as shown in FIG. 4 so that the pressure of the air in the space 36 is increased to the pressure of the supply air. As the piston 32 continues to advance, the diametrical slot 33 opens into the enlarged bore portion 49 extending forward of the bore 48 of the second cylinder 9 whereupon the pressure air trapped in the space 36 is discharged into the enlarged bore 49 forward of the front end of the piston, so that the energy for advancing the piston 32 is lost.

After the piston 32 hits the chisel 42 during its forward stroke of movement and loses its advancing energy, the space 36 is again closed to store an energy for retracting the piston 32, whereupon the piston is moved backward. As the space 36 comes into communication with the diametral slot 33 of the piston 32, the air pressure within the piston again begins to build up until the piston is again moved forward instantaneous. This cycle is repeated.

In this manner as the piston advances to strike the chisel 42 which is in turn moved forward, and as the piston retreats the chisel 42 is moved backward under the reaction force generated upon its forward movement, whereby impact vibrations are produced to perform the chipping operation.

Figure 3:
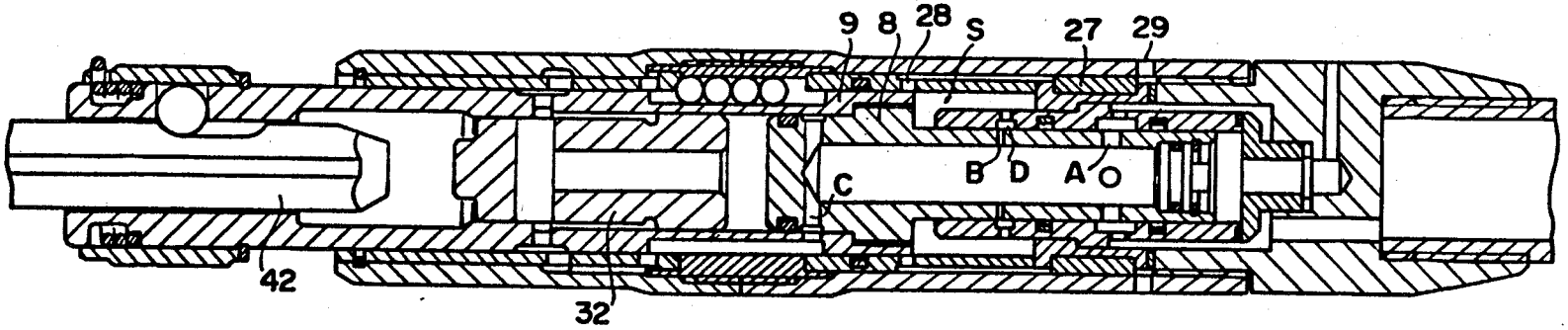

As the first and second cylinders 8, 9 are moved backward due to the impact shock as shown in FIG. 3, the air in the annular air space (S) is initially discharged through the exhaust holes 28 and 29 into the atmosphere until the exhaust holes 28 of the sleeve 22 are closed by the outer wall of the second cylinder 9 to increase the air pressure in the space (S) to thereby cushion the rearward movement of the cylinders. Continued rearward movement of the cylinders moves the air ports (B) of the first cylinder 8 into alignment with the outlet ports (D) of the outer sleeve 11 to permit the air in the space (S) to escape through the aligned ports (D) and (B) into the interior 19 of the first cylinder 8 so that the air in the space (S) continues to perform the cushioning function in a self-controlled manner. Further continued rearward movement of the cylinders moves the air ports (B) out of alignment with the ports (D) of the outer sleeve 11 to again increase the air pressure in the space (S) so that the increased air pressure may accomplish the cushioning function during the final phase of the rearward stroke of the cylinders.

As the cylinders 8 and 9 are reversed in their movement and move forward, the ports (B) are moved out of alignment with the ports (D) while the exhaust holes 28 are communicated through the exhaust holes 29 with the atmosphere to substantially equalize the pressure in the space (S) with the atmospheric pressure.

ADVANTAGES OF THE INVENTION (A) As indicated hereinbefore, the prior art spring type cushioning device required cushioning spring means having a spring constant accommodating the supply air pressure, the frequency of vibrations, and impact forces involved, since the shock absorbing and vibration absorbing capabilities of the device depend on the spring constant. In contrast, the cushioning device according to this invention is capable of self-controllable function of absorbing shock and vibration in accordance with changes in the air pressure, so that it does not impose limitation on the pressure of supply air used and provides high flexibility in use.

(B) The cushioning spring can be completely collapsed upon being subjected to high impact force, resulting in collision between the moving parts. However, the present invention utilizes air pressure as a shock absorbing medium, which air pressure is increased to a level higher than the supply air to eliminate mechanical damages by preventing collision of the moving parts comprising the first and second cylinders with outer sleeve 11 which is the stationary part.

(C) In this invention it is only the cylinder assembly comprising the first and second cylinders 8, 9, the piston 32 and the chisel 42 that is vibrating during the operation. No substantial shock or vibration is transmitted to the front and rear housings 23, 24, the threaded connection between the rear housing 24 and the main body 6, and the main body itself. Consequently, no heavy shock load is imposed on the operator in operation, nor is any damage to the connection caused.

(D) The first and second cylinders 8 and 9 are made movable so that the operator must press the chisel 42 against the workpiece to retract the cylinders before the motion of the piston 32 can be initiated. Thus, the present invention provides means for preventing accidental operation of the tool, in addition to the cushioning function.

The above description is included to illustrate the construction and operation of the preferred embodiment and is not meant to limit the scope of the invention. From the above description, many variations will be apparent to one skilled in the art that would yet be encompassed by the spirit and scope of the invention. The scope of the invention is, therefore, to be limited by the following claims.

What is claimed is:

1. A cushioning device for a pneumatic impact tool or the like having an impact means such as a chisel and a housing means provided with first exhaust hole means opening to the atmosphere, said device comprising:

a rear cylinder closed at its front and rear ends and having air inlet port means and air port means in communication with the interior of the cylinder;

a front cylinder interconnected concentrically with the rear cylinder and closed at its rear end by the closed front end of the rear cylinder, said rear and front cylinders being axially slidably mounted in said housing means;

a piston mounted in the front cylinder for reciprocal sliding movement between the front closed end of the rear cylinder and said impact means;

a first outer cylindrical sleeve mounted over and coaxilly with the rear cylinder and within the housing means, the sleeve including an air outlet port means opening to said air space and communicable with said air port means;

a second outer cylindrical sleeve mounted over and coaxially with the front cylinder, the second outer cylindrical sleeve having second exhaust hole means communicable with said first exhaust hole means; and an air space defined at least in part by the end face of one of the rear cylinder and the front cylinder, a first outer cylindrical sleeve mounted over the rear cylinder, and a second cylindrical sleeve interposed between said cylinders and said housing means, said first outer cylindrical sleeve having air outlet port means opening to said air space and communicable with said air port means, said second cylindrical sleeve having second exhaust hole means communicable with said first exhaust hole means;

said first and second exhaust holes, said air inlet port means and said air outlet port means being arranged such that as the rear and front cylinders are moved backward due to reaction forces exerted on the piston when the impact means strikes a workpiece to reduce the volume of the air space, the air in the air space is initially discharged through the second and first exhaust hole means to the atmosphere until the second exhaust hole means is closed by the front cylinder whereafter the air pressure in the space is increased to cushion the rearward movement of the cylinders and such that continued rearward movement of the cylinders brings the air inlet port means into alignment with the air outlet port means to permit the air in the space to escape through the aligned port means into the interior of the rear cylinder so that the air in the space continues to perform the cushioning function in a self-controlled manner.

2. The cushioning device of claim 1 comprising in addition ball means disposed between the housing means and the cylinders to facilitate smooth axial movement of the cylinders while inhibiting circumferential movement of the cylinders with respect to the housing means.

3. A cushioning device for a pneumatic impact tool or the like comprising:

a housing having substantially cylindrical symmetry;

a first cylinder mounted within and coaxial with the housing;

a second cylinder attached to the first cylinder and coaxial with the housing;

a piston mounted within the second cylinder and coaxial with the second cylinder;

means for admitting compressed air into a bore of the piston to drive the piston into motion toward an impact device;

first port means for venting compressed air from the bore into an enlarged bore to reduce driving force on the piston;

second port means for admitting compressed air into a space to move the piston backward;

third port means for discharging air from a space that surrounds the first cylinder and is compressed by backward movement of the first and second cylinders when the third port means is closed to provide a first level of cushioning; and fourth port means for discharging a reduced volume of the compressed air in the space into an interior of the first cylinder to reduce pressure of the compressed air in the space to a lower value, thereby providing a second level of cushioning, and to vent the space to the atmosphere.

* * * * *